United States Patent [19]

Hoffmeister et al.

[11] Patent Number: 4,604,939

[45] Date of Patent: Aug. 12, 1986

[54] LIGHTWEIGHT COMPOSITE LAUNCHER POD

[75] Inventors: Lawrence D. Hoffmeister, New Market; Richard J. Thompson, Huntsville, both of Ala.

[73] Assignee: The United States of America as represented by the Secretary of the Army, Washington, D.C.

[21] Appl. No.: 642,850

[22] Filed: Aug. 20, 1984

[51] Int. Cl.[4] ..... F41F 3/04

[52] U.S. Cl. ..... 89/1.816; 89/1.8

[58] Field of Search ..... 89/1.816, 1.817, 1.818, 89/1.819, 1.8

[56] References Cited

U.S. PATENT DOCUMENTS

| | | | |
|---|---|---|---|
| 2,609,730 | 9/1952 | Bergström | 89/1.817 |
| 3,048,086 | 8/1962 | Robert et al. | 89/1.817 |
| 3,106,863 | 10/1963 | Robert et al. | 89/1.817 |
| 3,357,305 | 12/1967 | Clutz et al. | 89/1.816 X |
| 3,710,678 | 1/1973 | Abelin et al. | 89/1.816 |
| 3,754,497 | 8/1973 | Rusbach | 89/1.816 X |
| 3,841,197 | 10/1974 | Morrisey | 89/1.816 |
| 3,988,961 | 11/1976 | Banta et al. | 89/1.816 X |
| 4,296,669 | 10/1981 | Debona et al. | 89/1.816 |

FOREIGN PATENT DOCUMENTS

| | | | |
|---|---|---|---|
| 1394734 | 7/1963 | France | 89/1.816 |

*Primary Examiner*—David H. Brown

*Attorney, Agent, or Firm*—Anthony T. Lane; Robert P. Gibson; James T. Deaton

[57] ABSTRACT

A lightweight composite launcher pod which includes a multiplicity of elongated launcher tubes that are accurately aligned in a composite material with the composite material having four outer sides with alignment surfaces on three of the sides and bearing and alignment surfaces on the other side, and the lightweight composite launcher pod being capable of serving as the shipping and storage container for rockets before launching of the rockets as well as for launching the rockets therefrom when mounted in a launcher structure.

10 Claims, 7 Drawing Figures

LIGHTWEIGHT COMPOSITE LAUNCHER POD

DEDICATORY CLAUSE

The invention described herein may be manufactured, used, and licensed by or for the Government for governmental purposes without the payment to us of any royalties thereon.

CROSS REFERENCE TO RELATED APPLICATION

This application is related to applicants' copending application Ser. No.: 642,845 now U.S. Pat. No. 4,556,438 by Lawrence D. Hoffmeister and Richard J. Thompson in that this invention is made by the process disclosed in the copending application.

BACKGROUND OF THE INVENTION

In the past, an approach of a multiplicity of tubes has been to tie the tubes together along the length of the launch tubes to form a cluster of the individual tubes. This approach causes each individual tube to have its own individual strength for longitudinal stress as well as radial stress. Further, in this type construction, the tubes are generally made of metal which adds undesirable weight to the launch tube cluster. Therefore, it can be seen that there is a need for a lightweight tube launching structure that has a multiplicity of tubes of lightweight material that can withstand linear stress as well as radial stress and be clustered together in an accurate manner with each of the tubes aligned relative to each of the other tubes so that rockets can be launched from the tubes to be directed accurately to a target.

With the above need in mind, it is an object of this invention to provide a composite structure that is compact, lightweight, and economical as a structure for launching rockets.

Another object of this invention is to provide a composite launch tube structure in which the tubes are accurately aligned and of a structure such that the structure of each launch tube adds to the overall structure of the device from a reinforcing standpoint.

Still another object of this invention is to provide a composite structure that has excellent tube-to-tube alignment in which the axis of each tube is substantially parallel to the axes of the other tubes.

A still further object of this invention is to provide a composite launch tube structure in which the materials thereof are inexpensive and readily available.

Still another object of this invention is to provide a launch tube arrangement which requires no special maintenance or surface protection since none of the materials are metallic or made of a corrosive material.

Yet another object of this invention is to provide a launch tube structure that has alignment surfaces and bearing surfaces molded therein to allow the structure to be easily mounted in a structure for clustering a multiplicity of said composite launch pods in a structure that can be carried on a vehicle and aimed at particular targets.

A still further object of this invention is to provide a lightweight composite launcher pod which has a multiplicity of tubes molded therein but the structure being such that the number of tubes can be varied for each individual pod structure.

Still another object of this invention is to provide a lightweight composite launch pod arrangement which can be utilized and serve as a shipping container for the rockets that are to be fired therefrom.

Other objects and advantages of this invention will be obvious to those skilled in this art.

SUMMARY OF THE INVENTION

In accordance with this invention, a lightweight composite launcher pod is provided that includes a multiplicity of lightweight fiberglass tubes that are molded into a composite structure by syntactic foam material being molded around each of the tubes to provide structural support to the tubes and to have the tubes mounted relative to each other so that the axis of each of the tubes are generally parallel and the composite structure is provided with alignment surfaces on three sides of the composite launcher pod for allowing the structure to be easily mounted and accurately mounted in a launcher structure and the structure of the composite launcher pod also includes bearing and locking surfaces thereon which allow the launcher pod to be mounted in a launch structure and locked in position with the bearing surfaces being sufficient to withstand the loads imparted to the launch pod during firing of rockets from the launch tubes of the composite launcher pod.

DESCRIPTION OF THE PREFERRED EMBODIMENT

Figure 1:
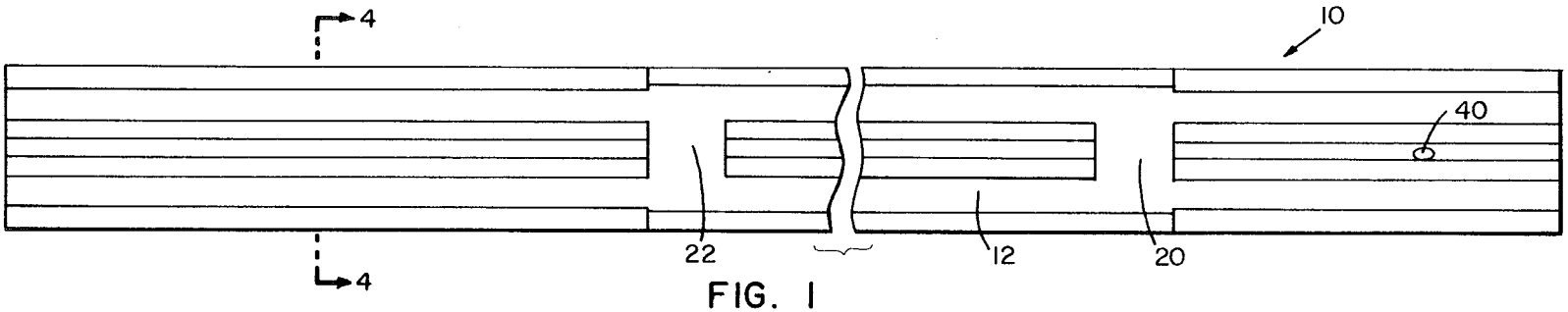
FIG. 1 is a side view of a composite launch pod in accordance with this invention and illustrating the side of the launch pod with the bearing and locking surfaces.
Figure 2:
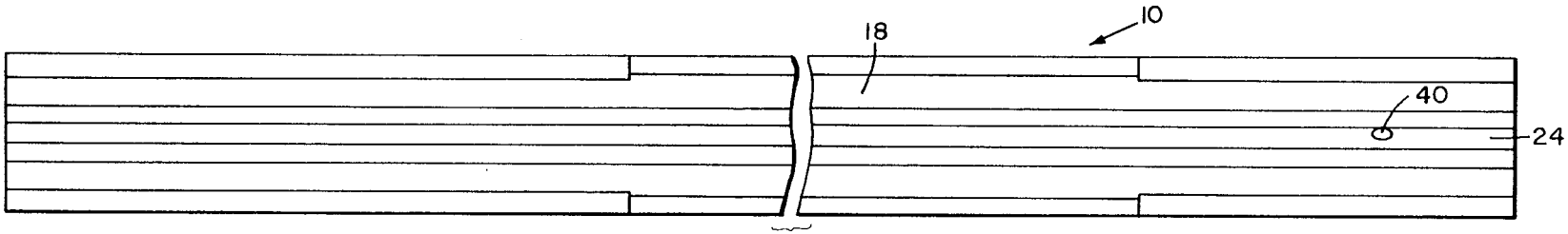
FIG. 2 is a side view of the composite launcher pod rotated 180° from the view of FIG. 1.
Figure 3:
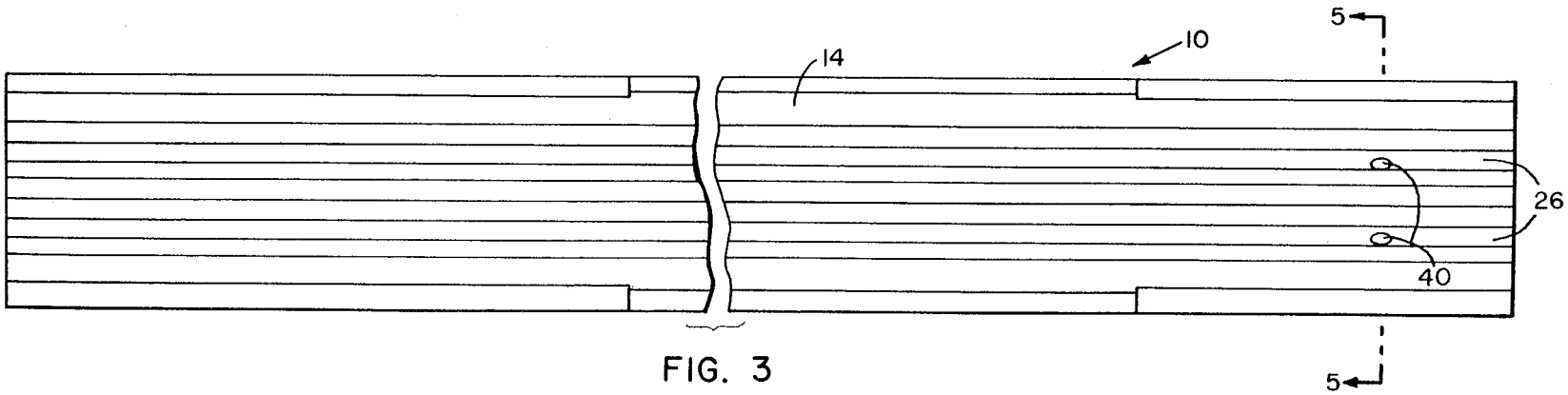
FIG. 3 is a top view of the composite launcher pod in accordance with this invention.
Figure 4:
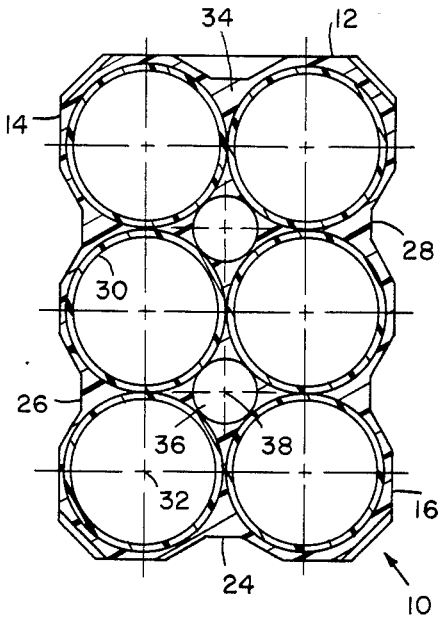
FIG. 4 is a sectional view along line 4—4 of FIG. 1.
Figure 5:
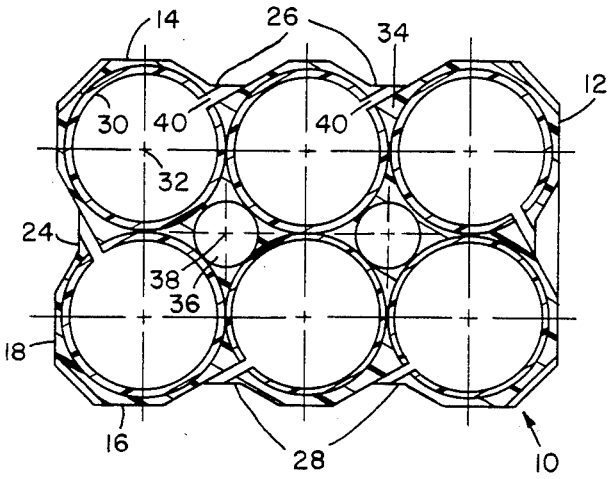
FIG. 5 is a sectional view along line 5—5 of FIG. 3.

Referring now to the drawings, a composite launcher pod 10 includes a four sided elongated body with a bearing and locking surface side 12, a top alignment side 14, a bottom alignment side 16, and an alignment side 18 that is opposite side 12. Bearing and locking side 12 has two bearing and locking surfaces 20 and 22 that extend over a very small distance of the overall length of the structure. Bearing and locking surfaces 20 and 22 are made only as large as necessary to provide sufficient structure to lock the composite launch pod in position in a launcher super structure and sufficient for bearing the launch load when rockets are being launched from the composite launch pod. In practice, in an overall structure with a length of about 57 inches, the length of bearing and locking surfaces 20 and 22 have each been about 1.5 inches. This has provided a structure that has ample strength for bearing the load that is exerted thereon during launching of rockets therefrom and is sufficient for locking the structure in position in a launcher super structure. If members 20 and 22 are not spaced as illustrated, but the structure is extended to also fill from member 20 to member 22, it has been found that the additional material on this side causes warpage or buckling of the structure during cure of the composite material. Therefore, bearing and locking surfaces 20 and 22 are spaced apart as illustrated and made of a small dimension in comparison to the overall length of the composite launcher pod structure. The opposite side 18 of composite launcher pod 10 has an alignment surface 24 that is perpendicular to alignment surfaces 26 of top side 14, and alignment surfaces 28 of bottom side 16 as viewed in FIG. 5. Surfaces 26 are located in the same plane and are parallel to each other and surfaces 28 are parallel to each other and in the same plane and surfaces 26 and 28 are each parallel to each of the other surfaces. Alignment surfaces 28 are also perpendicular to alignment surface 24. By providing the identical alignment surfaces 26 and 28 at the top and bottom of the composite launcher pod structure 10, this structure can be flipped over so that the bearing and locking surfaces can be located either on the left side of the overall structure or on the right side of the structure when mounted in a launcher super structure. Further, the composite launcher pod includes six fiberglass tubes 30 each of which has a center axis 32 along the longitudinal length of the composite launcher pod. Each of axis 32 is substantially parallel to each of the other axes 32. Also, axes 32 are substantially parallel to the longitudinal lengths of surfaces 24, 26 and 28. As can be appreciated, a balanced structure is provided in which the fiberglass tubes 30 and alignment surfaces 24, 26 and 28 are precision made for adapting the composite launcher pod to be accurately mounted in a launcher super structure and accurately aimed at a target. A syntactic foam material structure 34 surrounds each of the tubes 30 and provides an integral unitary and balanced structure for the precision mounting of tubes 30 and providing a structure with precision alignment surfaces 24, 26 and 28 as well as bearing and locking surfaces 20 and 22. The structure also includes two longitudinal openings 36 therethrough that have an axis 38 that is also substantially parallel to each of axes 32. Openings 36 cause the syntactic material 34 about tubes 30 to be more balanced and also openings 36 make for a lighter structure. Alignment surfaces 24, 26 and 28 are each indented in on the sides where they are to also provide for a more balanced structure, a lighter structure, and to provide surfaces that can be aligned utilizing a longitudinal bar structure in an appropriate support. Tubes 30 are made of E-glass filament that is tow wetted with epoxy resin and later cured with the entire composite structure. Even though E-glass filament has been used, other filament can be used such as other fiberglass material, Kavlar, graphite, or other equivalent materials. Syntactic foam material 34 includes a mixture of epoxy resin and glass microballoons that incapulate tubes 30 to form the overall structure. A specific mixture of high viscosity syntactic foam that has been used to form the syntactic material includes a mixture of Epon 826 epoxy resin by Shell Chemical Company in an amount of 2,400 grams per batch, Araldite epoxy RD2 accelerator catalyst in an amount of 600 grams per batch, Tonox 6040 curative in an amount of 720 grams per batch, 250 Micro-balloons in an amount of 470 grams per batch, and a Cab-o-sil thickening agent in an amount of 140 grams per batch. In some applications, it is desirable to omit the Tonox from the mixture. The above numerated mixture has been found to provide an especially good high viscosity syntactic foam that is readily usable in applicants' invention to produce a composite launch tube pod that is very durable, lightweight and one that can be used to have the surfaces and tubes accurately aligned. Also, the syntactic foam material is so durable that it enables the pod structure to be used as a carrying and transporting case for rockets that are mounted therein. That is, this lightweight composite launch pod structure is such that the rockets can be shipped in the tubes and even when fully loaded the overall structure is light enough to be lifted by a single person.

Figure 7:
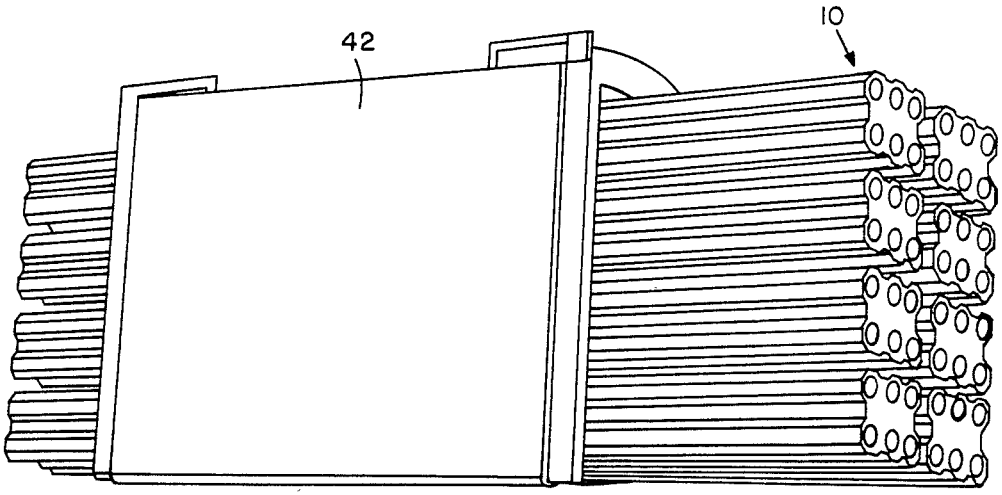
FIG. 7 is a perspective view illustrating a multiplicity of the composite launcher pods mounted in a launcher super structure that is adapted to be mounted on a vehicle such as a helicopter.
Figure 6:
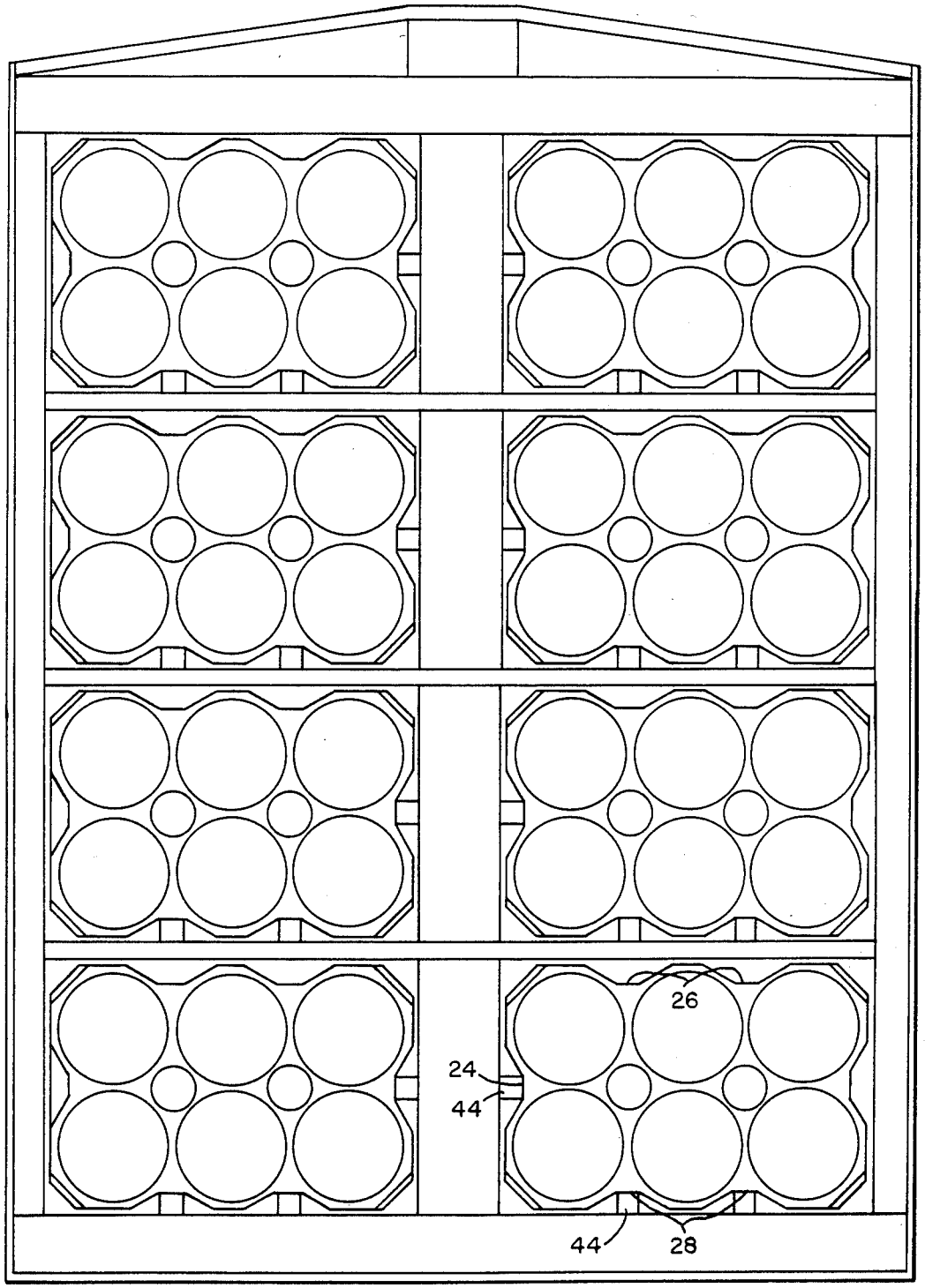
FIG. 6 is an end view illustrating positioning of a multiplicity of the composite launcher pods in a launcher super structure.

Composite launched tube pod 10 has an opening 40 (see FIG. 5) drilled into each tube 30 to allow a brass fitting (not illustrated) to be inserted and a detent pin (not illustrated) to be mounted therein and project into a groove on the rocket to initially hold the rocket in place for shipping and until it is desired to launch the rocket from its desired tube 30. A plurality of lightweight composite launch pods 10 have been specifically designed to be loaded into a launching frame or structure 42 as illustrated in FIGS. 6 and 7. Launch frame 42 has three longitudinal bar shaped guide surface members 44 that contact alignment surface 24 and either alignment surfaces 26 or 28 depending upon whether the pod is mounted and secured from the left or the right side. As illustrated in FIG. 6, launch pods 10 are locked from the right side of the tubes located to the right of the structure and on the left side for the tubes located on the left side of the launching frame. These tubes are clamped in position in a conventional manner (not illustrated). In FIG. 7, the launching frame is illustrated in perspective and it can be seen that the launching frame is designed to be carried by a vehicle and aimed by the vehicle toward the target desired or targets desired to be destroyed. As can be seen, when the lightweight composite launch pods with rockets mounted therein have been mounted in the launch frame, with the rockets connected for firing, with the composite launch pods aimed at the desired target, the rockets can then be fired at the target as desired. It is pointed out that the composite launcher pod has been illustrated as containing six launch tubes 30 therein, however the configuration could contain 4, 6, 8, 9, 10, 12, or other additional tubes if desired. It has been found that for applicants' application, the six tube arrangement is desirable from an overall standpoint of weight, mounting and structure.

The lightweight composite launcher pods according to this invention can easily be made when using the process as disclosed in applicants' copending application Ser. No. 642,845 filed Aug. 20, 1984. The lightweight composite launcher pods of this invention provide a much lighter, compact, manageable, and durable structure over the prior art. It is pointed out that the composite launcher pod is made completely of non-metallic and non-corrosive materials but yet has ample strength as well as being capable of having the tubes accurately aligned for launching rockets therefrom. Also, the lightweight launcher pods are disposable after being used once due to cost and etc.

We claim:

1. A lightweight composite launcher pod comprising a multiplicity of elongated composite launch tubes that are mounted in a cluster in a composite material that completely surrounds each of said elongated launch tubes about the circumference thereof and for the length thereof with the axis of each of the elongated launch tubes being substantially parallel to each of the other axes and said composite material having outer surfaces that bearing and locking structure on one side of said composite launcher pod, an alignment surface on said composite material and on an opposite side of said launcher pod from said bearing and locking structure, and alignment surfaces on said composite material that are parallel and on opposite sides of said launcher pod such that said parallel alignment surfaces on opposite sides are perpendicular to said alignment surface on said side opposite said bearing and locking structure, said alignment surfaces each being spaced inwardly from outer most side surfaces and being spaced so as to produce a more uniform thickness of said composite material surrounding said elongated launch tubes.

2. A lightweight composite launcher pod as set forth in claim 1, wherein said alignment surfaces are longitudinal of said structure from one end to the other and each of said alignment surfaces are substantially parallel along the longitudinal length thereof to the axis of each of said elongated launch tubes.

3. A lightweight composite launcher pod as set forth in claim 2, wherein said composite launcher pod has a longitudinal opening means therethrough that is surrounded by said launch tubes and said opening means serving to provide a more balanced composite structure around the launch tubes and providing a lighter weight structure.

4. A lightweight composite launcher pod as set forth in claim 3, wherein said multiplicity of launch tubes include six and wherein said opening means includes two openings along the longitudinal length thereof.

5. A lightweight composite launcher pod as set forth in claim 4, wherein said parallel alignment surfaces on said opposite sides are two in number on each side and said bearing and locking structure of said outer surfaces include two members that are longitudinally spaced on said one side.

6. A lightweight composite launcher pod as set forth in claim 5, wherein each of said launch tubes has an opening therein from which securing means can be mounted for mounting rockets therein.

7. A lightweight composite launcher pod as set forth in claim 5, wherein each of said launch tubes is made of fiberglass material.

8. A lightweight composite launcher pod as set forth in claim 7, wherein said composite material is a cured syntactic foam material.

9. A lightweight composite launcher pod as set forth in claim 8, wherein said syntactic foam material has glass micro-balloons therein.

10. A lightweight composite launcher pod as set forth in claim 8, wherein said syntactic foam material is a mixture of epoxy resin and glass micro-balloons to provide a composite structure that is non-metallic and non-corrosive.

* * * * *